US006725798B1

(12) United States Patent
Hill

(10) Patent No.: US 6,725,798 B1
(45) Date of Patent: Apr. 27, 2004

(54) CANOE PLATFORM

(76) Inventor: Robert A. Hill, 3563 Rte. 89, Seneca Falls, NY (US) 13148

( * ) Notice: Subject to any disclaimer, the term of this patent is extended or adjusted under 35 U.S.C. 154(b) by 0 days.

(21) Appl. No.: 10/345,560

(22) Filed: Jan. 16, 2003

Related U.S. Application Data

(60) Provisional application No. 60/349,393, filed on Jan. 18, 2002.

(51) Int. Cl.[7] ..... B63B 1/00
(52) U.S. Cl. ..... 114/347; 114/61.22
(58) Field of Search ..... 114/347, 61.1, 114/61.22, 61.23

(56) References Cited

U.S. PATENT DOCUMENTS

| | | | | | |
|---|---|---|---|---|---|
| 2,748,740 | A | | 6/1956 | Villar | 114/39 |
| 2,944,505 | A | | 7/1960 | Berge | 114/39 |
| 3,614,937 | A | | 10/1971 | Schulman | 114/66.5 |
| 3,796,175 | A | | 3/1974 | Ford, Jr. et al. | 114/39 |
| 3,883,909 | A | * | 5/1975 | Fisher et al. | 114/352 |
| 4,562,786 | A | | 1/1986 | Pruonto | 114/61 |
| 4,766,830 | A | | 8/1988 | Kunz | 114/61 |
| 4,817,548 | A | | 4/1989 | Guergen | 114/61 |
| 4,829,926 | A | | 5/1989 | Voelkel | 114/61 |
| 5,522,339 | A | * | 6/1996 | Pelly | 114/354 |
| 5,540,169 | A | | 7/1996 | Davis et al. | 114/61 |
| 5,542,370 | A | | 8/1996 | Castleberry | 114/352 |
| 5,784,980 | A | | 7/1998 | Benefiel | 114/263 |
| 5,988,087 | A | | 11/1999 | Pepper | 114/61.1 |
| 6,067,925 | A | | 5/2000 | Little | 114/354 |
| 6,302,042 | B1 | | 10/2001 | Biedenweg et al. | 114/61.22 |
| 6,345,582 | B1 | * | 2/2002 | Dudink | 114/61.15 |

* cited by examiner

*Primary Examiner*—Stephen Avila
(74) *Attorney, Agent, or Firm*—Brown & Michaels, PC; Eugene Stephens & Associates

(57) ABSTRACT

A canoe platform interconnects a pair of spaced apart canoes arranged parallel with each other so that the platform can support human activity while the canoes support the platform above the water. The platform is made of a pair of panels adjoining each other and spanning the gunwales of the canoes and the space between them. Each of the panels is foldable in half longitudinally so that the panels can be stored within canoes for transport. The panels are unfolded flat and are arranged to span the canoes aft of the front seats of the canoes and forward of the rear seats of the canoes.

23 Claims, 7 Drawing Sheets

CANOE PLATFORM

This application claims the benefit of U.S. Provisional Application No. 60/349,393, filed on Jan. 18, 2002, which provisional application is incorporated by reference herein.

TECHNICAL FIELD

Platforms interconnecting and bridging a space between a pair of canoes.

Background

Many suggestions exist for dual hull boats, pontoon boats, and for platforms inter-connecting a pair of boats or canoes. All of these tend to be sufficiently cumbersome and expensive so that they are not readily assembled and disassembled and thereby made portable.

SUMMARY OF THE INVENTION

The invention aims at a simple, inexpensive and portable platform that inter-connects and bridges a space between a pair of canoes so that the platform is as conveniently portable as the canoes themselves. The invention also aims at quick and convenient assembly and disassembly of such a canoe platform, and includes a variety of features, conveniences, and accessories enabling such a canoe platform to be used in a variety of ways.

DRAWINGS

DETAILED DESCRIPTION

Figure 1:
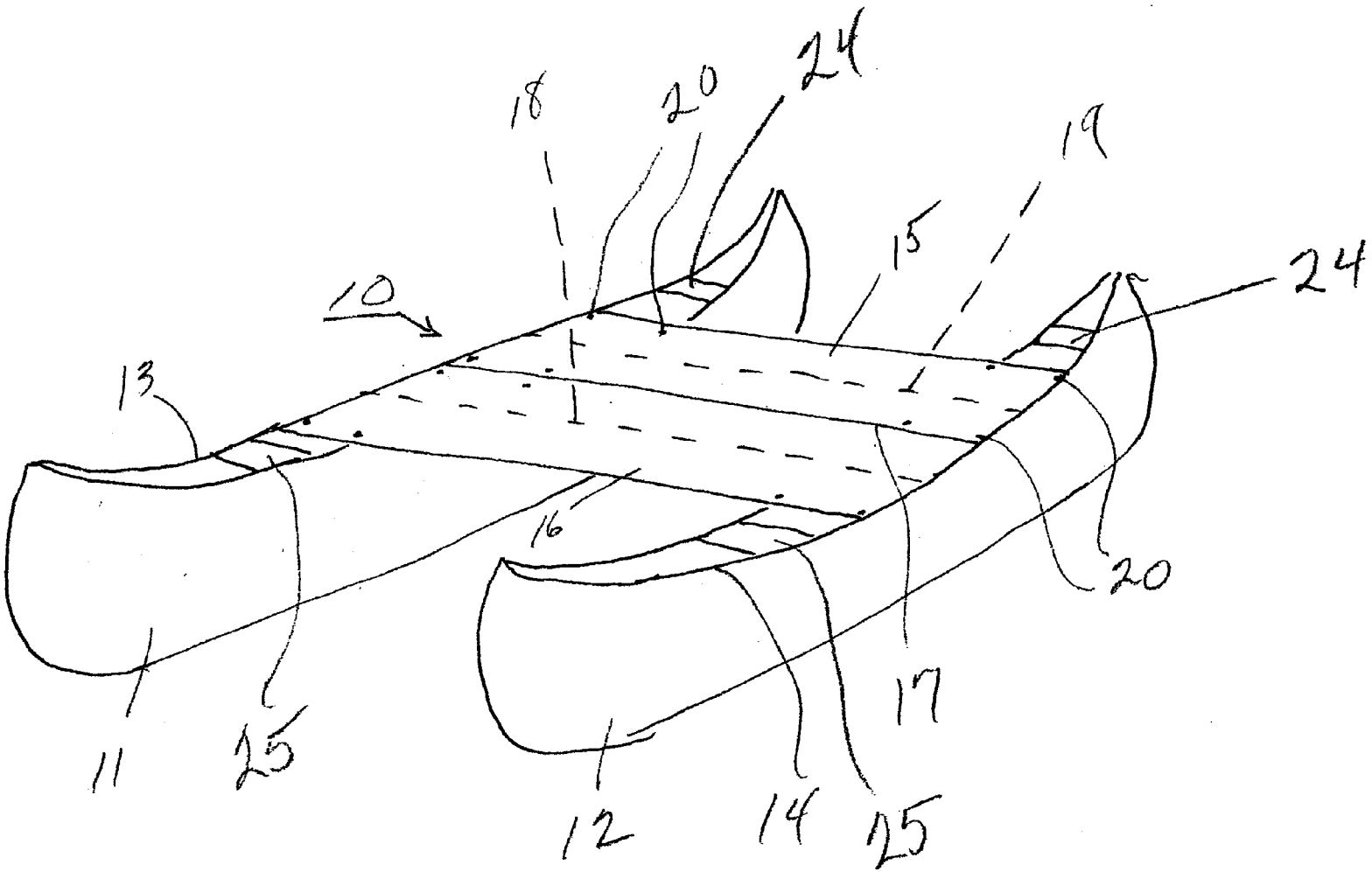
FIG. 1 is a partially schematic perspective view of a preferred embodiment of the inventive canoe platform as mounted on a pair of canoes.

Platform 10, as shown in FIG. 1, interconnects and spans a distance between a pair of canoes 11 and 12. To make platform 10 portable and easy to assemble and disassemble, it is preferably formed of a pair of panels 15 and 16, each of which is preferably about 4 feet by 8 feet. This allows each panel 15 and 16 to be formed of a single sheet of 4×8 plywood or similar material. Panels 15 and 16 are preferably laid side by side along a junction line 17 to form a continuous deck approximately 8 feet square, when assembled onto a pair of canoes as illustrated. Panels 15 and 16 can be clamped or removably locked together along junction line 17, but this is normally not necessary.

Figure 7:
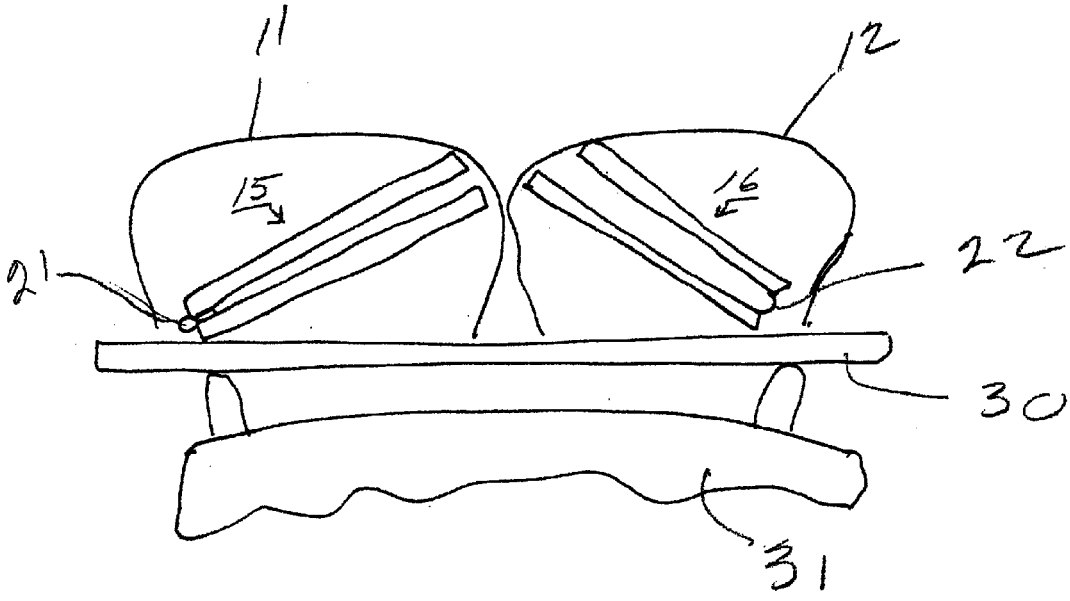
FIG. 7 is a partially schematic cross-sectional view showing a pair of canoes supported on a roof rack of a vehicle with folded sections of the canoe platform of the previous drawings stowed within the canoes for transport.

Panels 15 and 16 can overhang the outboard gunwales 13 and 14 of canoes 11 and 12, or they can be trimmed to a curvature fitting those gunwales. Each panel 15 and 16 is preferably split and hinged along respective broken lines 18 and 19 so that each of the panels 15 and 16 can be folded in half into an approximate 2 foot by 8 foot dimension. This further facilitates the portability and transport of panels 15 and 16, since each panel, when folded along fold line 18 or 19 becomes stowable within one of the canoes 11 or 12. One such possibility is illustrated in FIG. 7 showing folded panels 15 and 16 arranged within canoes 11 and 12 on a roof rack 30 of a vehicle 31.

Fasteners or clamps 20 preferably secure each of the panels 15 and 16 to canoes 11 and 12 in regions where the panels overlie the canoe gunwales. A variety of fasteners and clamps can be used for this, including screw clamps, cam clamps, bolts and nuts, hook and loop fabric fasteners, magnetic retainers, and other holding devices. It is even possible to drill holes in panels 15 and 16 to align with corresponding holes formed in the canoe gunwales, and simply drop nails through the aligned holes to secure the panels to the canoes. Whatever fastening or clamping arrangement is selected, the objects are to keep platform 10 inexpensively positioned on the canoes and insure that platform 10 interconnects canoes 11 and 12.

The hinging of panels 15 and 16 along fold lines 18 and 19 can also be done in a variety of ways. Piano hinges, strap hinges, and fabric hinges are among those possibilities, and FIG. 7 illustrates a conventional or piano hinge 21 arranged to allow panel 15 to fold, and a strap or fabric hinge 22 arranged to allow panel 16 to fold.

A top surface of panels 15 and 16 is preferably covered with a fabric or outdoor carpet material that is water resistant and comfortable for bare feet. This also covers the plywood, provides a satisfying color, and trims platform 10 neatly. Many different fabrics, carpets, plastics, felts, and fibrous materials can accomplish this, the preferred criteria being lightweight, water resistance, durability, attractiveness, and inexpensiveness. Such a top covering material can also serve as a hinge element along fold lines 18 and 19 where the top covering material can allow panels 15 and 16 to be folded in half while the halves remain connected.

Figure 2:
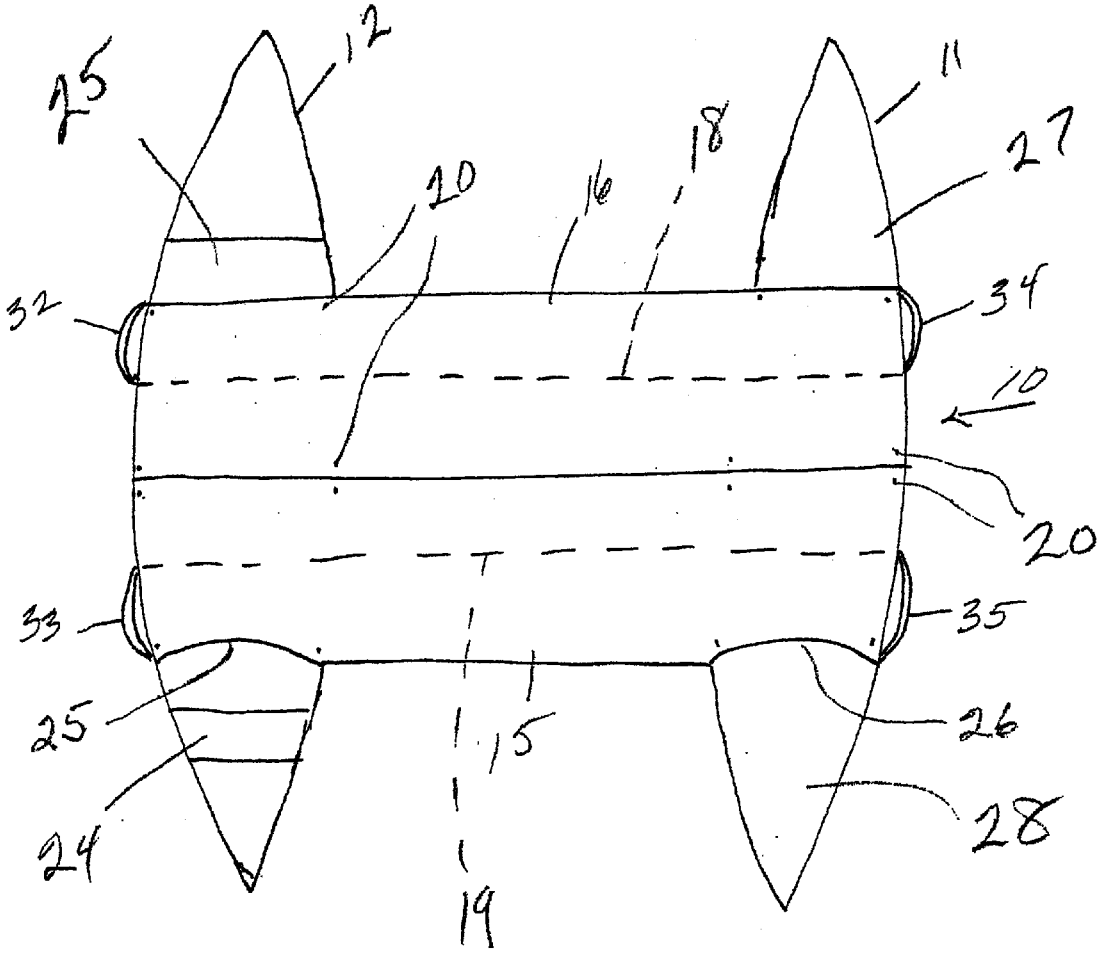
FIG. 2 is a partially schematic plan view of a canoe platform of the type shown in FIG. 1, formed with knee room for rear seat paddlers, formed with carrying handles, and showing possible bow and stern covers for one of the canoes.

A few additional features are illustrated for the platform 10 illustrated in FIG. 2. Rear or stern most panel 15 has curved cutouts affording knee room to paddlers occupying rear seats 24 of canoes 11 or 12. Front seats 25 are preferably forward of foremost panel 16.

FIG. 2 also illustrates a bow cover 27 and a stern cover 28 that covers over the portions of canoe 11 not covered by platforms 15 and 16. This keeps rainwater out of canoe 11 when it is not in use. Launching and moving the canoes and platform requires removing protective covers 27 and 28 to accommodate paddlers in stern seat 24 or bow seat 25.

Another feature illustrated for platform 10 of FIG. 2 is four carrying handles 32–35 arranged on the ends of panels 15 and 16. This facilitates picking up and folding each of the platforms 15 and 16 when unclamped from canoes 11 and 12. Handles 32–35 can have many shapes and be made of different materials, the criteria being effectiveness, comfort, convenience and economy.

Figure 3:
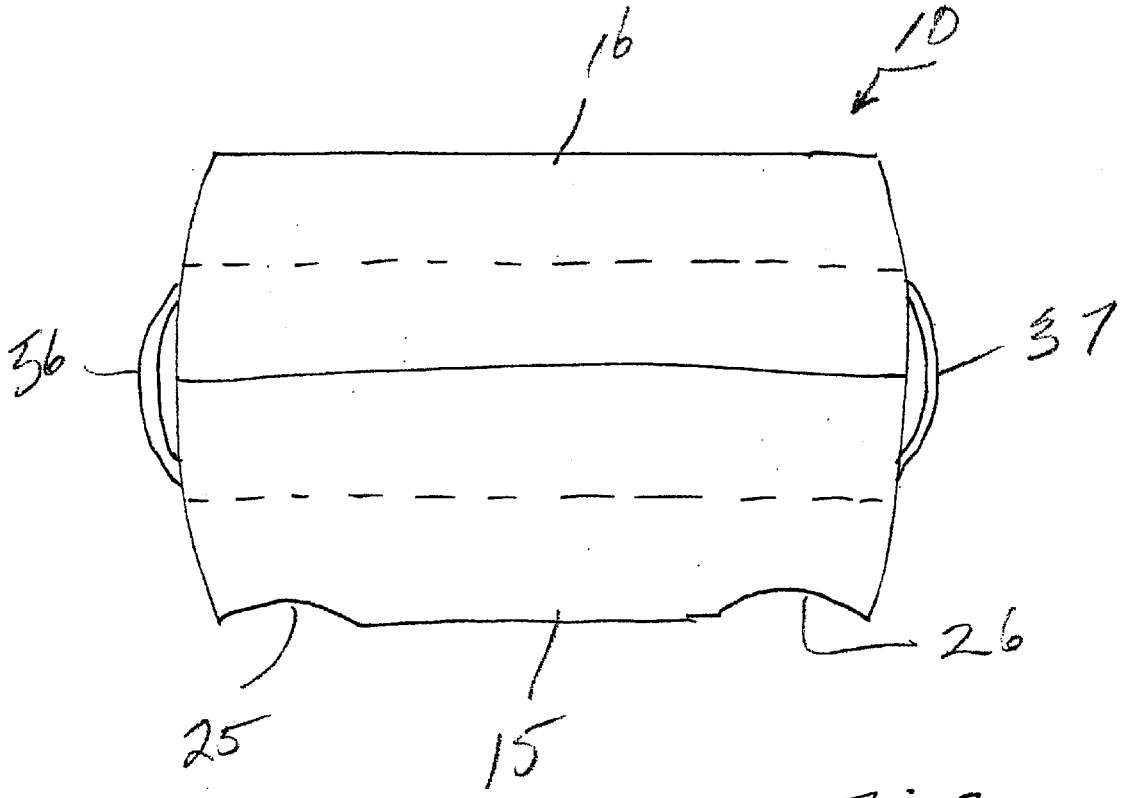
FIG. 3 is a partially schematic plan view of a canoe platform of the type shown in FIGS. 1 and 2 formed with a different carrying handle enabling the entire platform to be lifted and removed from the canoes.

Handles 36 and 37, as shown in FIG. 3, span panels 15 and 16 to allow lifting of the entire panel 10 off from a pair of canoes or onto a pair of canoes. This requires that handles 36 and 37 be clamped or fastened to panels 15 and 16 and be removable from panels 15 and 16 to allow their separation and folding for transport. Again, many handle configurations are possible, different materials can be used, and a variety of clamps or removable connectors can arrange for the mounting and dismounting of handles 36 and 37.

Figure 4:
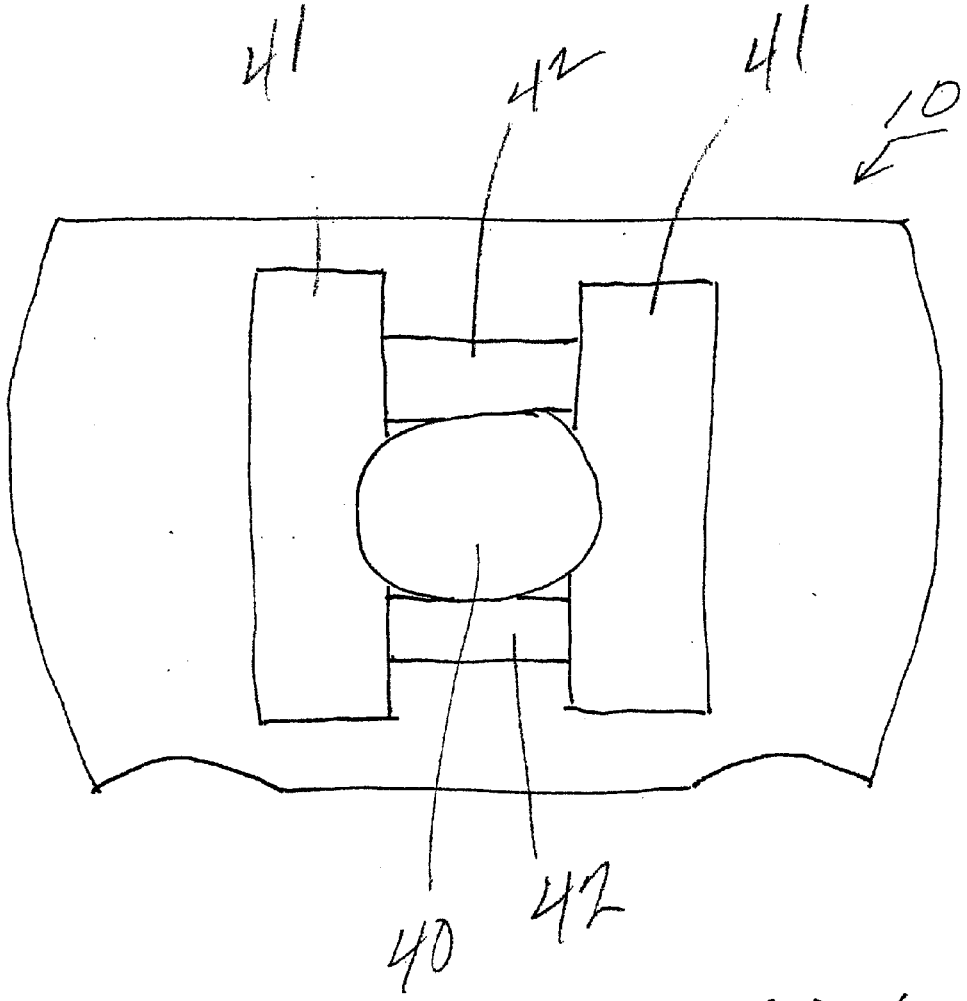
FIG. 4 is a partially schematic plan view of a canoe platform of the type shown in the previous drawings equipped with a pair of beds, a pair of seats, and a table, to illustrate some of the accessories that are possible with the inventive canoe platform.

Platform 10 of FIG. 4 is shown supporting a pair of single beds or bunks 41 preferably at a height that allows beds 41 to serve as seats next to a table 40. A pair of additional seats 42 can extend between beds 41 as illustrated to provide four seats around table 42. Beds or lounging platforms can be arranged in a variety of ways on platform 10 and need not be associated with a table. In turn many arrangements of tables and chairs are possible within the approximately 8 foot square platform afforded by deck 10.

Figure 5:
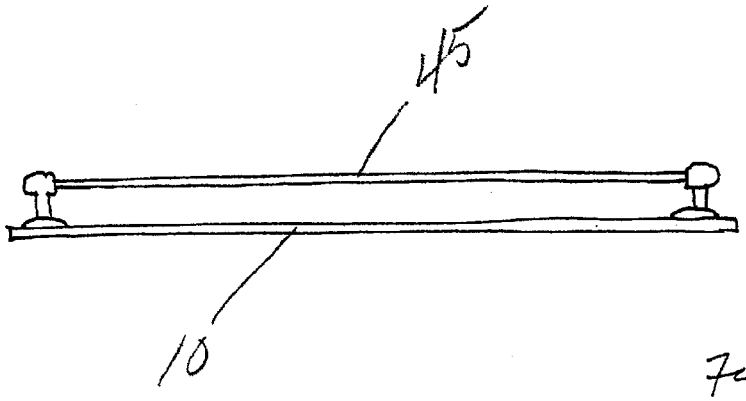
FIG. 5 is a partially schematic elevational view of a railing arranged on a top surface of a canoe platform to retain chairs, tables, and other accessories within the boundaries of the canoe platform.
Figure 6:
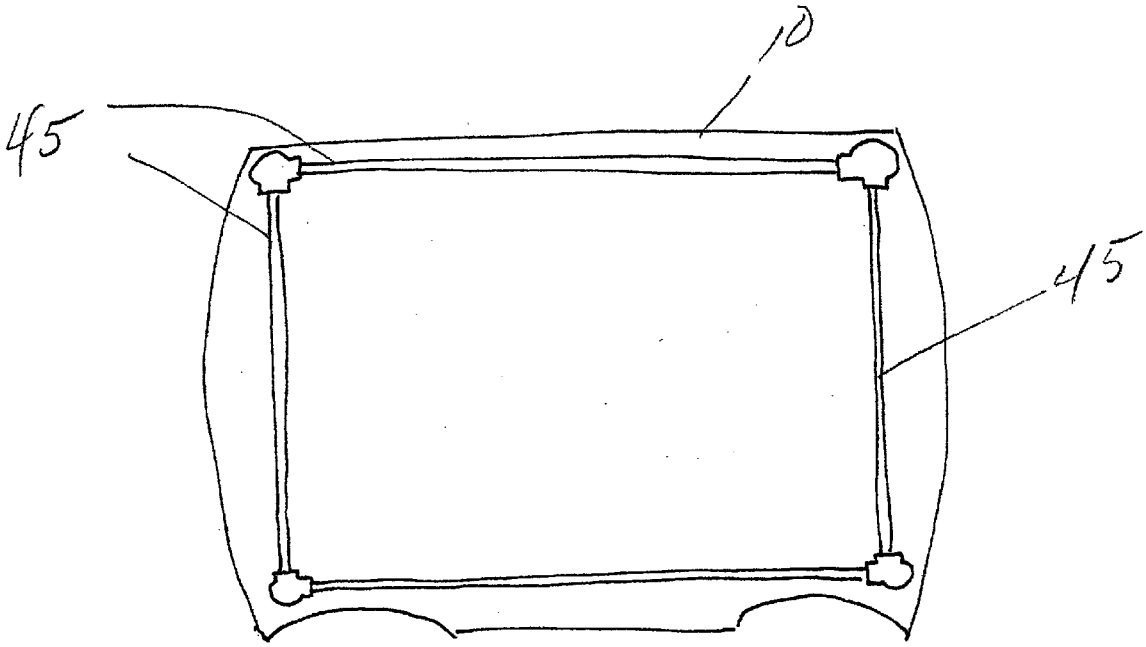
FIG. 6 is a partially schematic plan view of the platform and railing of FIG. 5.

Ordinary chairs, tables, and other accessories can be arranged on platform 10, and many of these benefit from a railing 45 such as illustrated in FIGS. 5 and 6, to keep such objects from sliding overboard. Such a railing is preferably made to assemble and disassemble conveniently.

Figure 8:
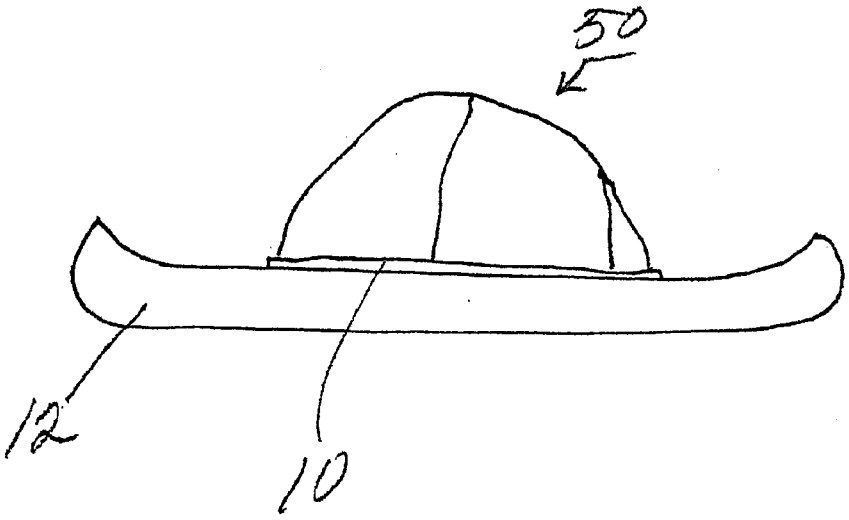
FIG. 8 is a partially schematic elevational view of a canoe platform mounting a camping tent.

Another convenient accessory for canoe platform 10 is a camping tent 50 as shown in FIG. 8. Many variations of lightweight fabric tents use crossed arch supports that fit neatly within the preferred dimensions of canoe platform 10. Any arrangement that leaves the tent reasonably accessible from either the canoes or the platform itself can be arranged on platform 10 to shelter canoe campers.

Figure 9:
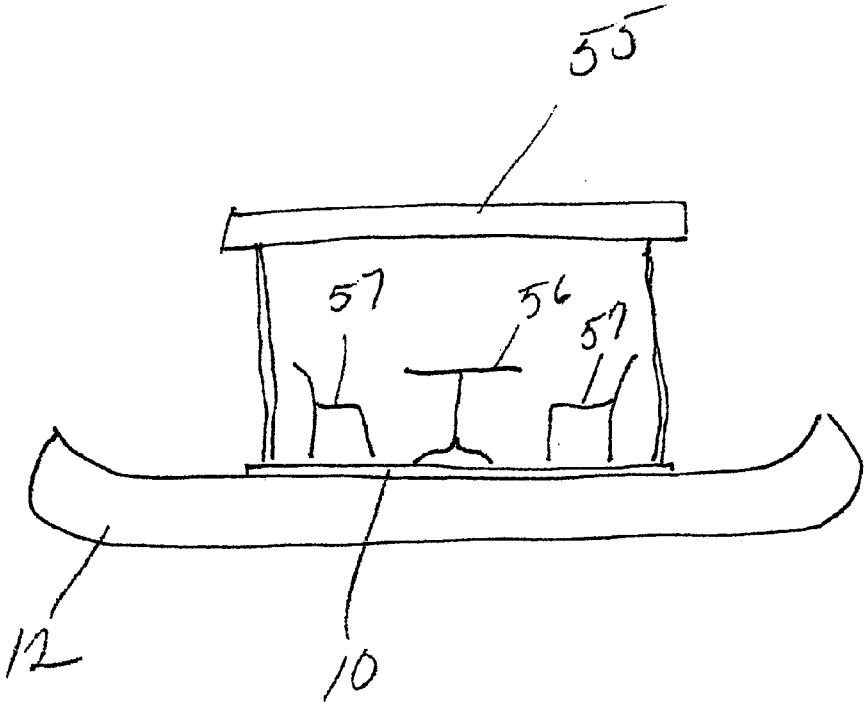
FIG. 9 is a partially schematic elevational view of a canoe platform mounting a canopy covering a table and chairs.

A canopy 55 is another shelter possibility that can be arranged on canoe platform 10, as schematically shown in FIG. 9. Canopy 55 can provide sun shade and rain protection for table 56 and chairs 57, or any other accessories arrangeable on platform 10.

The illustrations cover only a few of the many uses of canoe platform 10. Its inexpensiveness and portability allow it to be deployed for many other purposes such as fishing, swimming, regattas, social gatherings, hunting, and many other water related activities within the extensive ingenuity of humans.

I Claim:

1. A canoe platform comprising:

a. a pair of panels dimensioned to extend between a pair of canoes;

b. the panels adjoining each other along an abutment line approximately perpendicular to the keels of the canoes;

c. each of the panels extending from outboard gunwales of the canoes across the canoes, over inboard gunwales of the canoes, and across a space between the canoes;

d. each of the panels being divided into halves that are foldable along a hinge line extending lengthwise of the panels; and e. the panels being formed of a material strong enough to support human activity on the space between the canoes.

2. The canoe platform of claim 1 wherein the panels interconnect the canoes.

3. The canoe platform of claim 1 wherein a forward one of the panels is disposed aft of front seats of the canoes.

4. The canoe platform of claim 1 wherein an after one of the panels is disposed forward of the rear seats of the canoes.

5. The canoe platform of claim 4 wherein the after one of the panels has cut outs providing room for people on the rear seats.

6. The canoe platform of claim 1 wherein the panels have hinge elements that keep the panel halves interconnected whether the panel halves are folded or laid flat.

7. The canoe platform of claim 1 wherein the panels have a top covering material arranged over a structurally supportive substrate.

8. The canoe platform of claim 1 wherein the panels have carrying handles.

9. The canoe platform of claim 1 wherein the platform is about 8 feet square.

10. The canoe platform of claim 1 wherein the halves of the panels are about 8 feet by 2 feet.

11. A platform interconnecting a pair of spaced apart canoes arranged parallel with each other so that the platform can support human activity while the canoes support the platform above water, the platform comprising:

a. a pair of panels, each of the panels being foldable in half along a longitudinally extending hinge line;

b. each of the panels being formed of a pair of structurally supporting substrates having a top covering material;

c. each of the panels being approximately 8 feet long and 4 feet wide when unfolded and 2 feet wide when folded in half;

d. the panels being arranged adjacent each other aft of front seats of the canoes and forward of rear seats of the canoes; and e. the panels being connected to the canoes to form the platform.

12. The canoe platform of claim 11 combined with bow and stern covers extending over bow and stern portions of the canoes not covered by the platform.

13. The canoe platform of claim 11 wherein an aft edge of the platform has cut outs positioned forward of the rear seats.

14. The canoe platform of claim 11 wherein the top covering material is arranged to serve as a hinge material when the panels are folded in half.

15. The canoe platform of claim 11 including hinge elements arranged between the panel halves along the hinge lines.

16. The canoe platform of claim 11 wherein the panels have carrying handles.

17. A canoe platform comprising:

a. a pair of panels that are each foldable longitudinally in half to be narrow enough to be stored inside a canoe for transport on a roof rack;

b. the panels being unfoldable to be laid flat to extend across a pair of parallel and spaced apart canoes;

c. a forward one of the panels being arranged aft of the front seats of the canoes, and an aft one of the panels being arranged forward of the rear seats of the canoes;

d. the panels extending across both gunwales of both canoes and spanning a space between the canoes;

e. the panels being connected to the canoe gunwales; and f. the panels being formed of structurally supporting substrates having a top covering material.

18. The canoe platform of claim 17 wherein an aft edge of the aft one of the panels has cut outs arranged forward of the rear seats.

19. The canoe platform of claim 17 including hinge elements arranged to allow folding and unfolding of the panels.

20. The canoe platform of claim 17 wherein the panels have carrying handles.

21. The canoe platform of claim 17 wherein the platform is about 8 feet square.

22. The canoe platform of claim 17 wherein the panels when folded are about 8 feet by 2 feet.

23. The canoe platform of claim 17 combined with covers for bow and stern regions of the canoes not covered by the platform.

* * * * *